US007168510B2

(12) United States Patent
Boyle et al.

(10) Patent No.: US 7,168,510 B2
(45) Date of Patent: Jan. 30, 2007

(54) ELECTRICAL TRANSMISSION APPARATUS THROUGH ROTATING TUBULAR MEMBERS

(75) Inventors: Bruce William Boyle, Cloucestershire (GB); Geoff Downton, Stroud (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 268 days.

(21) Appl. No.: 10/904,171

(22) Filed: Oct. 27, 2004

(65) Prior Publication Data

US 2006/0086536 A1 Apr. 27, 2006

(51) Int. Cl.
*E21B 4/02* (2006.01)
*H04B 10/22* (2006.01)

(52) U.S. Cl. ..... 175/107; 166/65.1; 175/320; 340/854.8; 340/855.1

(58) Field of Classification Search ..... 175/320, 175/40; 166/65.1; 340/854.8, 855.1
See application file for complete search history.

(56) References Cited

U.S. PATENT DOCUMENTS

| | | | | |
|---|---|---|---|---|
| 3,448,305 | A * | 6/1969 | Jean et al. | 310/17 |
| 4,011,917 | A | 3/1977 | Tiraspolsky et al. | 175/107 |
| 4,397,619 | A | 8/1983 | Alliquander et al. | 418/48 |
| 4,436,168 | A * | 3/1984 | Dismukes | 175/94 |
| 4,475,605 | A | 10/1984 | Ioanesian et al. | |
| 4,711,006 | A | 12/1987 | Baldenko et al. | |
| 4,725,837 | A * | 2/1988 | Rubin | 340/854.5 |
| 4,806,928 | A | 2/1989 | Veneruso | 340/856 |
| 5,052,941 | A * | 10/1991 | Hernandez-Marti et al. | 439/194 |
| 5,911,284 | A | 6/1999 | von Gynz-Rekowski | 175/107 |
| 6,148,933 | A * | 11/2000 | Hay et al. | 175/73 |
| 6,247,542 | B1 | 6/2001 | Kruspe et al. | 175/40 |
| 6,359,569 | B2 * | 3/2002 | Beck et al. | 340/856.3 |
| 6,360,820 | B1 | 3/2002 | Laborde et al. | 166/66 |
| 6,392,317 | B1 | 5/2002 | Hall et al. | 307/90 |
| 6,427,783 | B2 | 8/2002 | Krueger et al. | 175/40 |
| 6,515,592 | B1 | 2/2003 | Babour et al. | 340/854.4 |
| 6,527,512 | B2 | 3/2003 | Bertin et al. | 415/200 |
| 6,540,032 | B1 * | 4/2003 | Krueger | 175/40 |
| 6,561,290 | B2 | 5/2003 | Blair et al. | 175/107 |
| 6,577,244 | B1 | 6/2003 | Clark et al. | 340/854.6 |
| 6,637,524 | B2 | 10/2003 | Kruspe et al. | 175/40 |
| 6,641,434 | B2 | 11/2003 | Boyle et al. | 439/577 |
| 6,655,460 | B2 | 12/2003 | Baily et al. | 166/301 |
| 2002/0193004 | A1 | 12/2002 | Boyle et al. | |
| 2004/0016571 | A1 | 1/2004 | Krueger | |
| 2004/0150532 | A1 | 8/2004 | Hall et al. | |
| 2005/0284662 | A1 * | 12/2005 | Hall et al. | 175/40 |

FOREIGN PATENT DOCUMENTS

| | | |
|---|---|---|
| WO | WO0127435 | 4/2001 |

* cited by examiner

*Primary Examiner*—Hoang Dang
(74) *Attorney, Agent, or Firm*—Matthias Abrell; Brigitte L. Echols; Dale V. Gaudier

(57) ABSTRACT

The present invention provides an apparatus for the communication of power or data signals across the rotating gap of two tubular members, such as the stator and rotor of a mud motor, and between said rotating members of a drill string through inductive couplers located axially along the drill string.

23 Claims, 2 Drawing Sheets

ELECTRICAL TRANSMISSION APPARATUS THROUGH ROTATING TUBULAR MEMBERS

BACKGROUND OF THE INVENTION

The present invention relates generally to downhole tools for use in oilfield drilling operations. More particularly, the present invention relates to the transmission of power and/or data between downhole tools in a drill string and a downhole control sub (or, alternatively, the surface) through coupled inductors located on the longitudinal ends or shoulders of rotating tubular members, such as on the ends or shoulders of a mud motor.

As is well known in the industry, hydrocarbons are recovered from underground reservoirs, by drilling borehole or wellbore with a rotating drill bit attached to the bottom of a drilling assembly. The drilling assembly is attached to the bottom of a tubing member, which can be either rigid or flexible. The apparatus comprising the tubing is commonly referred to as the "drill string" consists of a long string of sections of drill pipe that are connected together end-to-end through threaded pipe connections. When a jointed pipe is employed as the drill string, the drill bit is either rotated by rotating the drill string from the surface and/or by a mud motor located proximate the drill bit at the distal end of the drill string. During drilling, a drilling fluid known as "drilling mud" or "mud" is supplied under pressure into the drill string to provide lubrication and cool the drill bit, as well to carry debris created by the drill bit during the drilling of the wellbore, such as for example, drill cuttings. The fluid exits through ports located in the drill bit at the end of the drilling assembly.

A mud motor drive shaft located within the drill string can be rotated by the passage of the drilling fluid at high pressure through the drill string assembly. Typically, drilling fluid is pumped from the surface to the drill bit through the bore of the drillstring, and is allowed to return with the cuttings through the annulus formed between the drillstring and the drilled borehole wall. Various conventional arrangements for drilling can employ a first tubular member which is rotationally moved by the rotation of the rotary table at the surface and which provides a connection to a second tubular member which moves independently of said first tubular member. The benefits of sensing and actuating movement of the drill bit independently of the rotation of the rotary table warrants placement of sensors at or near the drill bit to provide signals relating to speed and direction. Conveying signals from these sensors can pose problems if the drill bit assembly moves at speeds varying from the movement of the upper tubular members. Additionally, in conventional drilling applications, some types of bits assemblies have been developed to employ shock absorber systems allowing recoil from the drill bit to be isolated from the drill string. If a drill bit provides sensors which detect abnormal torque, bit hopping or bit bounce, the movement of the rotary table can be selectively altered to minimize shocks to the drill string. Modern sensors can use this data to modify rotary speed and direction signals to the drill bit assembly. The present invention can be utilized to provide communication path from the drill bit to the control sub or the surface.

Directional drilling is the intentional deviation of the wellbore from the path it would naturally take. In directional drilling, the drill string can include a rotary steerable system (RSS) which forces the drillstring to move in a desired path. Other types of deviation means include a bent sub which remains in fixed relation to the desired target zone. While a bent sub cannot be rotated from the surface, since it must remain in fixed orientation to the target zone, a rotary steerable system can be activated to directionally drill a bore while continuously being rotated by a standard rotary drilling rig. Continuous drill string movement is desirable because it is thought to aid in the prevention of sticking the drillstring in the borehole, thereby avoiding expensive pipe recovery operation.

Mud motors have become widely used in directional drilling assemblies. Generally, these motors provide a fixed member or stator and a rotating member or rotor, wherein the rotor is powered by the high pressure flow of drilling fluid through the drillstring thereby providing motive force to the drill bit assembly connected to the rotor.

Communication during drilling operations between the downhole tools and components generally located below the mud motor and other downhole control subs containing processing equipment located above the mud motor, or even the surface, is critical for real time monitoring and control of variables associated with the tools.

Heretofore, acoustic signaling systems were limited to 8 bits per second transmission rates which are hardly satisfactory to obtain real-time information concerning the status or location of the drill bit assembly. Alternate methods of communicating with downhole drill string tools include the use of wireline control. Wireline control, which allows for the transmission of up to 1200 bits per second, requires a separate conductor. The separate conductor can obstruct the wellbore and can be damaged during the insertion and removal of tools from the wellbore.

Another method of communicating information is a wired assembly wherein a conductor runs the length of the drill string and connects the components of a drill string to the surface, as well as to each other. In U.S. Pat. No. 6,655,460, Bailey et al. disclose a method for transmitting a signal and/or power between the surface and any component in the drill string through the use of a wired pipe. The advantage obtained is a higher capacity for transmitting information in a shorter amount of time. However, these systems can have problems in transferring signals between sequential joints in a drill string.

U.S. Pat. No. 6,392,317 to Hall et al. discloses an annular wire harness for use inside a section of drill pipe for communication of power and data through the drill pipe.

U.S. Pat. No. 6,515,592 to Babour et al. discloses an apparatus and method for providing electrical connections to permanent downhole oilfield installations using an electrically insulated conducting casing.

U.S. Pat. No. 6,427,783 to Krueger et al. and U.S. Pat. No. 6,540,032 to Krueger disclose a method for the contact-less transfer of power across a non-conductive radial gap of rotating and non-rotating members of a steering module.

In U.S. Pat. No. 6,641,434, expressly incorporated herein by reference, Boyle et al. disclose a method for the use of inductive couplers in a wired pipe joint for communication with the drillstring.

None of the existing communication transmission systems allow or permit communication through an interface between two independently moving tubular members in a well bore. While the present invention is not limited to a mud motor application, a preferred embodiment shown herein provides the most efficient means of discussing the structure and benefits of the present invention. Use of the mud motor embodiment should not be construed to limit this invention to mud motor connections.

SUMMARY OF THE INVENTION

With the use of reamers and underreamers which require rotation of the drillstring with mud motors to drive the drill bit, communication between the rotary steerable system (RSS) and the measurement while drilling (MWD) devices and the control sub or the surface can be problematical. The present invention provides an apparatus and method for the transmission of power and/or data over a longitudinal gap between the components of downhole oilfield tubular members moving at different angular velocities, such as a mud motor, to control and track the progress of the bottom hole assembly (BHA).

The present invention discloses an apparatus and method for the transfer of signals and/or power across a gap between rotating and non-rotating members, as well as across a gap between two members rotating synchronously, asynchronously, or in an opposite direction. The gap may contain a non-conductive fluid, such as drilling fluid (mud) or oil for the operation of downhole devices. In a mud motor according to the present invention, the stator, which as stated previously may be rotating in a synchronous, asynchronous or in an opposite direction in reference to the rotor, provides inductors located at opposite longitudinal ends of each tubular member, connected by a connection extending axially from the first inductor to the second inductor. The inductors transfer power and/or data through both tubular members, such as through the rotor and stator of a mud motor, to devices located downhole or to a control sub or the surface located above the tubular members.

A first embodiment of the present invention comprises a drill string communication apparatus for the transmission of electromagnetic energy comprising: (a) a first tubular member providing a longitudinal axial bore there through, said first tubular member having a first end containing a first toroidal inductor and a second end containing a second toroidal inductor, and providing a conductor from said first inductor to said second inductor; (b) a second tubular member having a first end extending into the longitudinal axial bore of said first tubular member and rotatably supported therein; (c) said second tubular member further providing an enlarged second end providing a connection to a drill string member, said enlarged second end having a shoulder adjacent the second end of the first tubular member providing a third toroidal inductor therein and a second end having a fourth toroidal inductor contained therein, and a conductor connecting the third inductor to the fourth inductor; (d) said first tubular member and said second tubular member forming an axial gap between the second end of the first tubular member and the shoulder of said second tubular member; and, (e) wherein an electromagnetic signal can be inductively transmitted from the first end of the first tubular member to the second end of the second tubular member.

The apparatus of claim may further include a cavity formed around the peripheral edge of each end of the first tubular member and the shoulder and second end of the second tubular member, each in longitudinal axial alignment with an adjacent peripheral cavity, to contain each inductor. The cavity can further include a high conductivity, low permeability layer disposed therein. Each inductor can be sealed within each cavity by a protective layer.

The second tubular member can be further adapted to receive downhole tools selected from the group consisting of: drill bits, stabilizers, reamers, rotary steerable systems, and sensory equipment, or combinations thereof.

The core of the conductor is desirably a ferrite material. The high conductivity, low permeability layer in the coil cavity desirably has a conductance greater than that of the material from which the mud motor is constructed, and may be selected from a group of materials from the group comprising: copper, brass, bronze, beryllium copper, aluminum, silver, gold, tungsten, and zinc.

The gap between the first tubular member and the second tubular member may comprise a fluid which may be selected from a group consisting of a drilling fluid, oil, a conductive fluid, and a non-conductive fluid. The first tubular member may be rotated through the rotation of the drill string. The rotation of the substantially stationary member and the rotating member may be synchronous, asynchronous or in opposite directions.

The present invention is also directed to a mud motor adapted for communication across a rotating gap, comprising: a mud motor comprising a stator and a rotor; wherein the stator comprises a first tubular member having a first and second end, wherein the first end contains a first toroidal inductor and a second end contains a second toroidal inductor, and provides a conductor from said first inductor to said second inductor; wherein the rotor comprises a second tubular member having a first end extending into the longitudinal axial bore of said first tubular member and rotatably supported therein; wherein the rotor further provides an enlarged second end providing a connection to a drill string member, said enlarged second end having a shoulder adjacent the second end of the stator providing a third toroidal inductor disposed therein and a second end having a fourth toroidal inductor disposed therein, and a conductor connecting the third inductor to the fourth inductor; wherein the stator and the rotor form an axial gap between the second end of the stator and the shoulder of said rotor; and an electromagnetic signal can be inductively transmitted from the first end of the stator to the second end of the rotor.

Other aspects and advantages of the present invention will become apparent after reading this disclosure, including the claims, and reviewing the accompanying drawings.

BRIEF DESCRIPTION OF THE DRAWINGS

The appended drawings illustrate typical embodiments of this invention and therefore should not be considered limiting in scope.

DETAILED DESCRIPTION OF THE INVENTION

In the interest of clarity, not all features of actual implementation are described in this specification. It will be appreciated that although the development of any such actual implementation might be complex and time consuming, it would nonetheless be a routine undertaking for those of ordinary skill in the art having the benefit of this disclosure. The present invention provides an apparatus and method for the transfer of power and the communication of signals between the surface and downhole tools in a drill string assembly through the use of inductive couplers.

In reference to the figures, like numbers have been used for like elements where possible.

As used herein, the terms "upper" and "lower", "proximal" and "distal", and "uphole" and "downhole" and other like terms indicate relative positions above or below a given element on an apparatus. Generally, "proximal" is used to describe the portion of the apparatus uphole and the term "distal" is used to describe the portion of the apparatus downhole when first attached to the BHA. It is understood that through the use of directional drilling, the wellbore can travel in a side to side orientation, rather than up and down. In this case, the portion of the drillstring closer to the drill bit located at the end of the drillstring is referred to as "distal" or "downhole" for purposes of describing relative position of the drillstring components.

Figure 1:
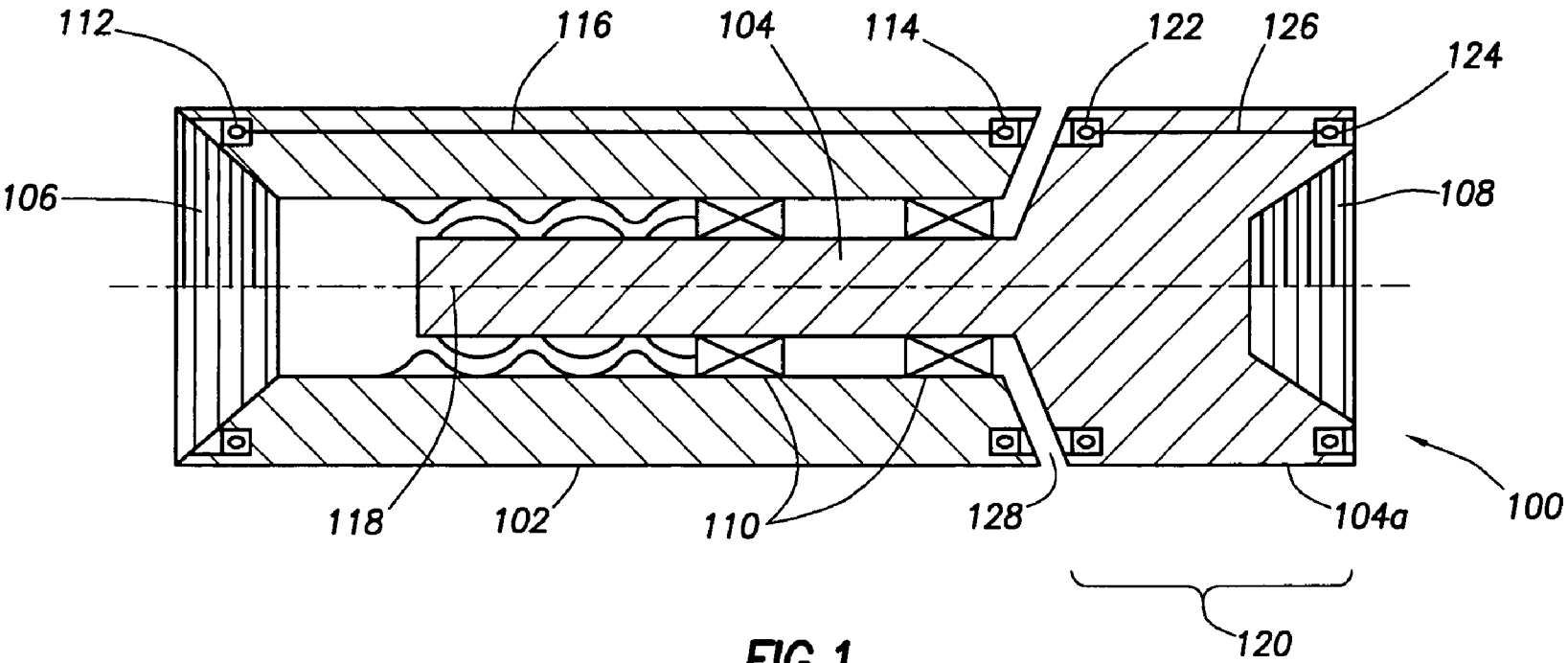
FIG. 1 is a schematic cross-sectional view of two tubular members, showing placement of the inductive couplers providing for communication of signal and power.

FIG. 1 shows the cross-section schematic of a typical mud motor 100, consisting of a stator 102 disposed about a rotor 104. The mud motor apparatus is connected to a drill string through a threaded connection 106 located at the proximal end of the apparatus 100. High pressure flow of the drilling fluid through the drillstring attached to the proximal end of the mud motor and rotates an attached drill bit (not shown), typically attached via thread 108 to the enlarged portion of the rotor 104*a* of the rotor 104, sometimes referred to as the bit collar. This connection may be direct or through one or more intermediate shaft arrangements (not shown) well known to those in the mud motor field. One or more bearing assemblies 110, disposed interior to the stator 102 and exterior to the rotor 104 within the longitudinal bore therein, support the radial and axial forces on rotor drive shaft 104 connected to the drill bit collar 104*a*. A stabilizer (not shown) may be positioned within the drillstring as is necessary, and can act as a centralizer for the lower portion of the mud motor. The drive shaft or an exterior of said shaft of the mud motor can be extended through a stabilizer body without departing from the scope or intent of the present invention, all in a manner well known in this art.

The stator body 102 of the mud motor provides a first inductor 112 inserted in a groove or cavity on its upper or first end and a second inductor 114 inserted in a groove or cavity formed in its lower or second end. Each toroidal inductor 112 and 114 is preferably formed from a ferrite ring around which a conductor is wrapped in a manner well known to the art. A conductor 116 preferably extends between inductors 112, 114 to permit an induced current in one inductor to energize the other.

The rotor body 104 of the mud motor provides a similar inductor 122 disposed in a groove or cavity in a shoulder of the bit collar 104*a* and an inductor 124 at the distal end of the enlarged portion 120 of the rotor 104, the end of the drill bit collar 104*a*. Likewise these two inductors are connected by one or more conductors 126 which allow the energized inductor to transmit its energy to the coupled inductor. Thus, a signal which energizes inductor 124 would consequently energize the inductor 122. Inductor 122 would create a field to energize the coil of inductor 114 which would energize inductor 112.

In an alternate embodiment, the mud motor apparatus can be rotated by the drill pipe assembly to either ream or underream a pilot hole created by the drill bit attached to the mud motor, or to effect changes in the drilling direction through the use of an RSS. In such an embodiment, having a mud motor within the rotating drillstring, both the stator and rotor of the mud motor can be rotating at different speeds. The rate of rotation of stator may be synchronous with the rotor, asynchronous, or alternatively, the stator and the rotor can rotate in opposite directions.

Figure 2:
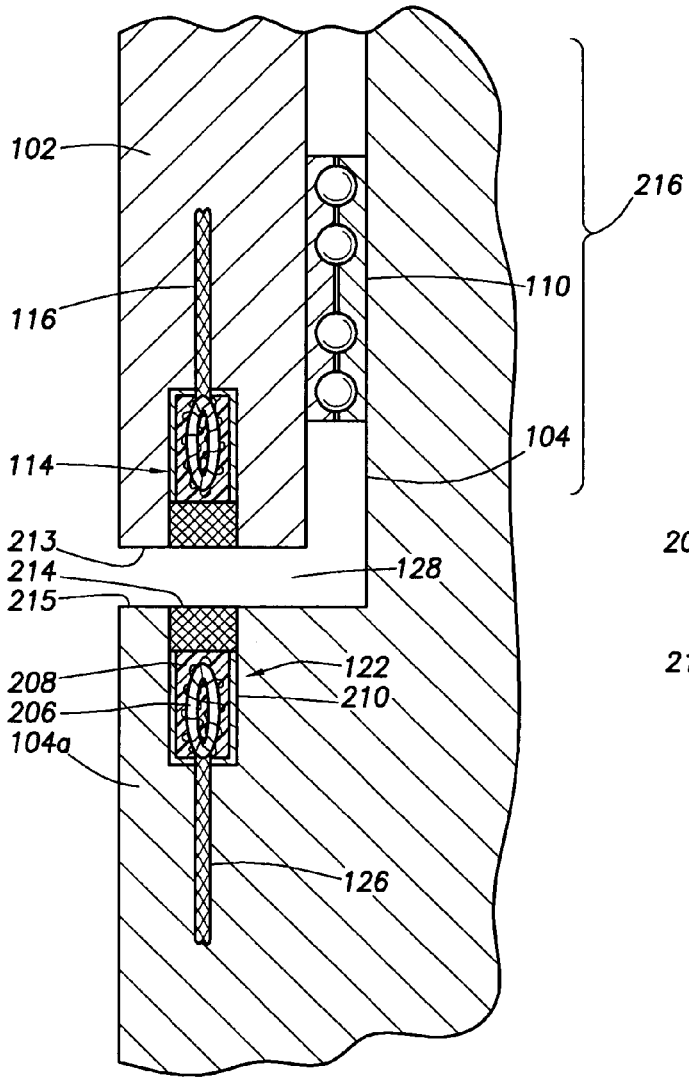
FIG. 2 is schematic sectional view of the adjacent inductors on the first and second tubular members, showing the placement of the inductive coupler devices.

FIG. 2 shows first stator inductor element 114, located at the downhole or second end 213 of stator 102. First stator inductor 112, as shown in FIG. 1, is connected to second stator inductor 114 via internal electrical conduit 116 which extends axially from the first end of the mud motor stator to the second end 213 of the mud motor stator, connecting the first and second stator inductors of stator 102.

Rotor 104 consists of a shaft portion 216 and a bit collar 104*a*, where the bit collar 104*a* provides a shoulder 215. The upper portion 118 of rotor 104 provides a shaft 216 of the mud motor which extends into the longitudinal bore of stator 102 and is retained therein by one or more bearings 110. Bit collar portion 104*a* of rotor 104 similarly contains a third inductor inserted in groove or cavity on the shoulder 215 and a fourth inductor on the lower end of the bit collar 104*a* (not shown in this view). The third and fourth inductors located in respective grooves on the bit collar portion 104*a* of rotor 104 are connected by conductor 126, extending therebetween.

The electrical conduit 126 connecting the inductors can be contained entirely within the surface of the mud motor, or it may be located in a groove extending axially down the outer surface of the mud motor.

Figure 3:
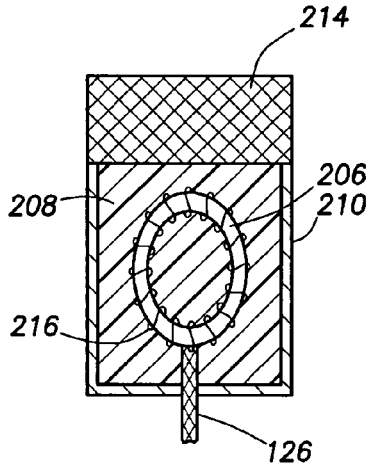
FIG. 3 is a schematic view of an inductor within a cavity on a tubular member.

As shown in FIG. 3, each inductive coupler element includes a coil 216 wrapped around a ferrite core 206, and a high conductivity, low-permeability layer 210. Each layer is located within the inner surface of the inductive coupler element slot. Each inductor is located between an inner and outer high conductivity, low permeability layer 210. Thus, the high conductivity, low permeability layer partially encloses the inductive coupler element on their interior radial and exterior radial walls. Each inductive coupler element is fixed in place by a potting material 208, such as for example, a fiberglass epoxy type material, and further protected by protective filler material 214.

Each inductive coil element preferably includes a coil 216, which induces an electrical current within the apparatus. Coil 216 generally consists of windings formed around a ferrite body core 206, all in a manner well known in the art. Each layer of the conductive material is located within the interior of the slot. Each inductor is then attached to an electrical conductor, such as 116 and 126, which connect coupled inductors on the stator and rotor respectively. While one embodiment for an inductor is shown, it should be understood by one of ordinary skill that any known inductor device may be used.

Transmission of signal between adjacent coils in an inductive coupler system has been described in U.S. Pat. No. 4,806,928 to Veneruso, entitled "Apparatus for Electromagnetically Coupling Power and Data Signals Between Wellbore Apparatus and the Surface," which is hereby incorporated by reference. Generally, the coil elements are sufficiently close to each other so that an electrical current generated in one of the coil elements is inductively coupled to the other adjacent coil element.

A high-conductivity, low-permeability layer 210 surrounding the wired core can include any high-conductivity, low-permeability material that has a conductivity substantially greater than that of the material from which the apparatus, i.e. the mud motor, is constructed. Suitable materials exhibiting high-conductivity and low-permeability include, but are not limited to, copper, copper alloys, silver, aluminum, gold, tungsten, zinc, and alloys and combinations of these materials.

The high-conductivity, low-permeability layer 210 reduces resistive losses over the length of the apparatus by enclosing the inductor within a less resistive environment than if the inductive coupler element were enclosed within the material of the apparatus itself. The high-conductivity, low-permeability layer 210 also reduces flux losses over the length of the stator or rotor by reducing magnetic flux penetration into the body of the stator of the mud motor.

The present technology allows for the improved use of rotary steerable systems (RSS) (not shown) as the need for an on-board battery pack may be eliminated as signals and/or power may be provided to the drill string and tools contained within the drill string through the use of inductive couplers.

In operation in a mud motor, as shown in FIG. 2, there will be an axial rotating gap 128 between the inductors located on the second end 213 of stator 102 and the upper edge of should 214 on the bit collar 104*a* of the rotor 104. Drilling fluid will be present in the gap 128. Thus, it is likely that the coupling will not be 100% effective. To improve the coupling and minimize the loss of efficiency through misalignment of the poles it is desirable that the inductors 114 and 122 have as large a surface area on the adjacent ends or shoulders of the stator and rotor. The present invention can also be used in conjunction with a wired pipe with joints providing inductors located at the joint ends for the transmission of measurement data through the pipe. Other downhole or bottom hole assembly tools may provide similar inductor arrangements.

The BHA may also include a sensory module is located near drilling bit. The sensor module can contain sensors and circuits permitting communication with the surface. The communication with the surface can be accomplished through mud motor acoustic signaling or by other telecommunication means. Such a sensory module may also be equipped with inductive couplers for the transfer and communication of signals and power through the drill string.

The foregoing description of the invention is illustrative and explanatory of the present invention. Various changes in the materials, apparatus, and particular parts employed will occur to those skilled in the art. It is intended that all such variations within the scope and spirit of the appended claims be embraced thereby.

What is claimed is:

1. A drill string communication apparatus to transmit electromagnetic energy, comprising:

a first tubular member providing a longitudinal axial bore there through, said first tubular member having a first end containing a first toroidal inductor and a second end containing a second toroidal inductor, and providing a conductor from said first inductor to said second inductor;

a second tubular member having a first end extending into the longitudinal axial bore of said first tubular member and rotatably supported therein;

said second tubular member further providing an enlarged second end providing a connection to a drill string member, said enlarged second end having a shoulder adjacent the second end of the first tubular member providing a third toroidal inductor therein and a second end having a fourth toroidal inductor contained therein, and a conductor connecting the third inductor to the fourth inductor;

said first tubular member and said second tubular member forming an axial gap between the second end of the first tubular member and the shoulder of said second tubular member; and wherein an electromagnetic signal can be inductively transmitted from the first end of the first tubular member to the second end of the second tubular member.

2. The apparatus of claim 1 wherein a cavity formed around the peripheral edge of each end of the first tubular member and the shoulder and second end of the second tubular member, each in longitudinal axial alignment with an adjacent peripheral cavity, to contain each inductor.

3. The apparatus of claim 2, wherein each cavity further includes a high conductivity, low permeability layer disposed therein.

4. The apparatus of claim 2, wherein each inductor is sealed within each cavity by a protective layer.

5. The apparatus of claim 1, wherein the first tubular member is a mud motor stator and the second tubular member is a mud motor rotor.

6. The apparatus of claim 1, wherein the first and second tubular members rotate independently of each other.

7. The apparatus of claim 6, wherein the first and second tubular members rotate synchronously.

8. The apparatus of claim 6, wherein the first and second tubular members rotate asynchronously.

9. The apparatus of claim 6, wherein the first tubular member rotates at a rate higher than the second tubular member.

10. The apparatus of claim 6, wherein the first and second tubular members rotate in opposite directions.

11. The apparatus of claim 1, wherein the inductor comprises a ferrite material.

12. The apparatus of claim 1, wherein the second end of the second tubular member is adapted to receive a downhole tool selected from the group comprising: drill bits, drill bit subs, stabilizers, reamers, rotary steerable systems, sensors, actuators or combinations thereof.

13. The apparatus of claim 3, wherein the high conductivity low permeability layer has conductance greater than that of the material from which the tubular member is constructed.

14. The apparatus of claim 3, wherein the high conductivity low permeability layer consists of a material selected from a group comprising: copper, brass, bronze, beryllium copper, aluminum, silver, gold, tungsten, and zinc.

15. The apparatus of claim 1, wherein the gap between the first and second tubular members comprises a fluid.

16. The apparatus of claim 15, wherein the fluid is selected from a group consisting of drilling fluid, oil, a conductive fluid, or a non-conductive fluid.

17. The apparatus of claim 15, wherein the first tubular member and the second tubular member may each be rotated independently.

18. A well tool to communicate across a gap, comprising:

a mud motor comprising a stator having a first and second end, said first end containing a first inductor and a second end containing a second inductor, and providing a conductor from said first inductor to said second inductor and a rotor having a first end extending into the longitudinal axial bore of said stator and being rotatably supported therein;

said rotor further providing a bit collar providing a connection to a drill bit, said bit collar having a shoulder adjacent the second end of the stator providing a third inductor therein and a second end having a fourth inductor contained therein, and a conductor connecting the third inductor to the fourth inductor;

said stator and said rotor forming an axial gap between the second end of the stator and the shoulder of said bit collar; and wherein an electromagnetic signal can be inductively transmitted from the first end of the stator to the second end of the bit collar.

19. The well tool of claim 18 wherein the first, second, third, and fourth inductors are toroidal.

20. The well tool of claim 18 further comprising a reamer positioned between the stator second end and the bit collar shoulder, said reamer providing an inductor adjacent its connection to the stator connected by a conductor to an inductor adjacent its connection to the bit collar to provide an induced signal path from a drill bit to said stator.

21. The well tool of claim 18 further comprising an underreamer positioned between the stator second end and the bit collar shoulder, said underreamer providing an inductor adjacent its connection to the stator connected by a conductor to an inductor adjacent its connection to the bit collar to provide an induced signal path from a drill bit to said stator.

22. The well tool of claim 18 further comprising a biasing unit of a rotary steerable system positioned between the stator second end and the bit collar shoulder, said biasing unit providing an inductor adjacent its connection to the stator connected by a conductor to an inductor adjacent its connection to the bit collar to provide an induced signal path from a drill bit to said stator.

23. A drill string communication apparatus comprising:

a first tubular member having a longitudinal bore, a first end providing a first inductor, and a second end providing a second inductor, said first tubular having a communication conduit between said first inductor and said second inductor;

a second tubular member having a first end extending into the longitudinal axial bore of said first tubular member and rotatably supported therein;

said second tubular member having an enlarged second end providing a connection to a drillstring, said enlarged second end having a shoulder adjacent the second end of the first tubular member providing a third inductor therein and a second end having a fourth inductor contained therein, and a conduit between the third inductor to the fourth inductor; and said first tubular member and said second tubular member forming an axial gap between the second end of the first tubular member and the shoulder of said second tubular member.

* * * * *